US005145430A

United States Patent [19]

Keys et al.

[11] Patent Number: 5,145,430

[45] Date of Patent: Sep. 8, 1992

[54] SURF CRAFT

[76] Inventors: Gary Keys, Lot 43, Ashton Street, Margaret River, Western Australia; Terry Keys, 5 Lakes Boulevard, Yamba, New South Wales; George Hamilton-Greenough, 4 Seven Mile Beach Road, Lennox Head, New South Wales, all of Australia

[21] Appl. No.: 669,494

[22] Filed: Mar. 14, 1991

[30] Foreign Application Priority Data

Sep. 13, 1989 [AU] Australia ..... PJ6335

[51] Int. Cl.[5] ..... B63B 35/79

[52] U.S. Cl. ..... 441/74

[58] Field of Search ..... 441/68, 74, 79; 114/39.2

[56] References Cited

U.S. PATENT DOCUMENTS

| | | | |
|---|---|---|---|
| 3,067,440 | 12/1962 | Blake | 441/68 |
| 3,317,937 | 5/1967 | Gallagher . | |
| 3,514,798 | 6/1970 | Ellis . | |
| 3,657,753 | 4/1972 | LeBlanc, Sr. . | |
| 3,929,549 | 12/1975 | Smith . | |
| 4,129,911 | 12/1978 | McDonald et al. , | |
| 4,209,867 | 7/1980 | Abrams | 441/74 |
| 4,276,844 | 7/1981 | Fremont . | |
| 4,556,003 | 12/1985 | Prade | 441/74 |
| 4,649,847 | 3/1987 | Tinker et al. . | |
| 4,753,836 | 6/1988 | Mizell | 441/74 |
| 4,767,369 | 8/1988 | Snyder | 441/74 |
| 4,887,986 | 12/1989 | Langenbach et al. | 441/74 |

FOREIGN PATENT DOCUMENTS

| | | | |
|---|---|---|---|
| 22269/83 | 6/1984 | Australia . | |
| 3019535 | 11/1981 | Fed. Rep. of Germany | 441/74 |
| 3447967 | 11/1985 | Fed. Rep. of Germany | 441/74 |
| 1472169 | 3/1967 | France | 441/68 |
| 2336954 | 7/1977 | France | 441/74 |
| WO83/00127 | 1/1983 | PCT Int'l Appl. . | |

*Primary Examiner*—Sherman Basinger
*Assistant Examiner*—Thomas J. Brahan
*Attorney, Agent, or Firm*—James R. Haller; David C. West; Edward S. Hotchkiss

[57] ABSTRACT

A surf craft such as a surfboard or windsurfer comprising a planing plank (15) forming the complete lower surface (14) of the craft and a stiffening spine (11) upstanding from and extending substantially the length of the planing plank (15). The spine (11) being integral with the planing plank (15) to form a structural unit with the planing plank projecting laterally from either side of the central spine. These lateral projections (31) of the planing plank (15) being independently resiliently deflectable in use relative to the central stiffening spine (11). Filler pads (35) on either side of the spine rest on and secured to the planing plank (15) to form with the spine a platform for a rider of the craft to stand and move about on when the craft is in use. The filler pads (35) being resiliently flexible with the planing plank.

9 Claims, 2 Drawing Sheets

SURF CRAFT

This invention relates to a surf craft and includes within its scope craft propelled by the wave motion and/or wind driven with or without sail assistance. The invention is particularly applicable to craft known as surfboards and windsurfers, and includes kneeboards and wave skis.

Surfboards, windsurfers and like surf craft are normally constructed of a core of foam material, enclosed completely in a skin of fibre reinforced resin. The core has little mechanical strength and principally provides a convenient way of applying the desired shape to the skin, the latter being the structural element of the craft.

It has been recognised for a considerable period that the performance of surf craft can be improved by constructing the main hull of the craft so that in use a controlled degree of flexing can be accommodated or induced to improve the performance of the craft. However, difficulty has been experienced in obtaining the required degree of flexibility whilst also maintaining the required basic strength to withstand the loads normally encountered when the craft is in use. Surf craft of this type, where the rider stands upon the upper surface of the craft, are subjected to considerable bending stresses which can lead to premature transverse fracturing of the craft. The bending stresses are increased by the fact that it is necessary for the rider of the craft to stand at a location where it is also desirable for the hull of the craft to be flexible.

In a windsurfer craft, the bending stresses are particularly high due to the concentration of the weight of the rider at one location and the wind load on the sails at a second location, which results in the development of high bending force where the mast is attached to the craft and where the rider is standing. This presents a difficulty in achieving flexibility together with the required strength.

Various forms of stiffening structures have been proposed in prior patents for incorporation into surfboards and like craft, however, the majority of these maintain the conventional basic surfboard construction of a lightweight core completely enclosed in an outer skin of fibre reinforced resin with the additional stiffening provided by longitudinally extending upright stiffening members located centrally of the width of the board. Typical examples of such prior proposals are to be found in international application W083/00127 by Mistral Windsurfing AEG and U.S. Pat. Nos. 4276844 by Freemont, 3514798 by Ellis and 3929549 by Smith. Ellis and Smith each disclose constructions wherein an upright stiffening member is located centrally of the width of the board and extending the full length thereof. In each construction, the reinforcing member extends continuously from the bottom to the top of the casing of the board so as to effectively tie the upper and lower casings together to provide increased stiffening of the board. In the Freemont U.S patent, there are provided laterally spaced longitudinally extending reinforcing strips which are encased within the core of the surfboard but extend in a vertical direction less than the complete height of the surfboard so as to be spaced from both the upper and lower enclosing skin of the surfboard. International application W083/00127 discloses a structure similar to that in the Freemont specification, however, the reinforcing members are vertically spaced rather than laterally spaced from one another and are each spaced from the upper and lower skins of the surfboard.

All of these prior proposed constructions require the reinforcing member or members to be enclosed within the core material of the surfboard which is usually of a foam material. This construction therefore normally requires the core material to be moulded in situ about the reinforcing members after which the core material is finally shaped and then enclosed in a skin of fibre reinforced resin.

It is the object of the present invention to provide a surf craft that-has the required flexibility in that portion thereof in contact with the water, whilst also incorporating the required strength in the area supporting the rider and/or the mast so as to reduce the bending stresses and hence fracturing of the hull.

With this object in view, there is provided according to the present invention, a surf craft comprising a planing plank forming the complete lower surface of the craft, a stiffening spine upstanding from and extending substantially the length of the planing plank, said spine being integral with the planing plank to form a structural unit with the planing plank projecting laterally beyond either side of the central spine, said lateral projections of the planing plank being independently resiliently deflectable in use relative to the central stiffening spine, and filler pads on either side of the spine and supported on the planing plank to form with the spine a platform for a rider of the craft to stand and move about on, said filler pads being resilient flexible with the planing plank.

The planing plank portions on either side of the spine are flexible in the transverse and longitudinal directions to the extent that in use the rider of the surfboard, windsurfer or like surf craft can control the contour of the outer or edge of the planing plank by appropriate positioning of his feet to control the distribution of his weight. The varying of the contour of the free longitudinal edge of the craft is part of the mechanism available to the rider in controlling the performance of surfboards and the like. However in conventional surfboards, where the board is of generally uniform construction across the full extent of the transverse cross-section, flexibility can only be obtained with a sacrifice in mechanical strength. Consequently it is not uncommon for high performance surfboards to fracture transversely as the high performance has been achieved by a sacrifice in strength. The combination of the planing plank and the upstanding longitudinal spine constructed as proposed by the present invention provides an effective combination of mechanical strength for longevity in service with a degree of flexibility in the longitudinal edges to provide a high level of performance.

It is accepted that different individual riders require different performance characteristics in their surf craft, and in the surf craft constructed as above described, spines of different rigidity or strength may be used, and that rigidity can vary along the length of the surfcraft as also can the flexibility of the portions of the planing plank on either side of the spine When the surf craft in accordance with the present invention is constructed as a windsurfer or sail board, provision is made in the spine for the attachment of the lower end of the mast thereto. Conveniently the mast is detachably secured to the spine The planing plank and spine of the surf craft may be made completely of a composite construction wherein a foam core of a one piece or a built up construction is laminated with one or more layers of fibre reinforced resin. Generally the foam material is not chosen primarily for its strength, but is to provide a former to impart the required shape to the fibre reinforced resin, and to exclude air from within the structure.

The central longitudinal spine is of a generally channel or U shaped cross-section, located in an inverted disposition on the planing plank The spine may be formed in situ on the planing plank or partly or wholly preformed and subsequently assembled with the planing plank. When the spine is formed in situ on the planing plank a core of suitable low strength foam material may be used to achieve the required cross-sectional shape of the spine. A suitable mould may be used, when the spine is formed independent of the planing plank, and fibre reinforced resin is layered-up therein. The spine is constructed to have a maximum strength against bending in the direction normal to the planing plank at a location spaced from each end of the craft and said strength decreases from said maximum toward each end of the craft.

The filler pads located on either side of the spine on the planing plank are not intended to contribute to the mechanical strength of the craft, but permit a continuous upper surface to be provided upon which the rider can conveniently move about It would be awkward for the rider to have to step over the spine as he moved about in the controlling of the surfcraft. The filler pads are preferably light as they occupy a substantial area of the upper side of the craft and could constitute a substantial component of the total weight of the craft if not made of a lightweight material. Also the extent of the filler pads and the light weight thereof contribute to the buoyancy of the craft. Non-resilient closed cell foam material of a density not greater than about 30 kg per cubic meter is suitable for this purpose. A relatively thin cover layer of higher density foam may be then provided overlying the pads and the spine to provide a more durable surface for the rider to stand on.

The invention will be more readily understood from the following description of one practical arrangement of the construction of the surf craft as illustrated in the accompanying drawings.

Referring now to the drawings

Figure 1:
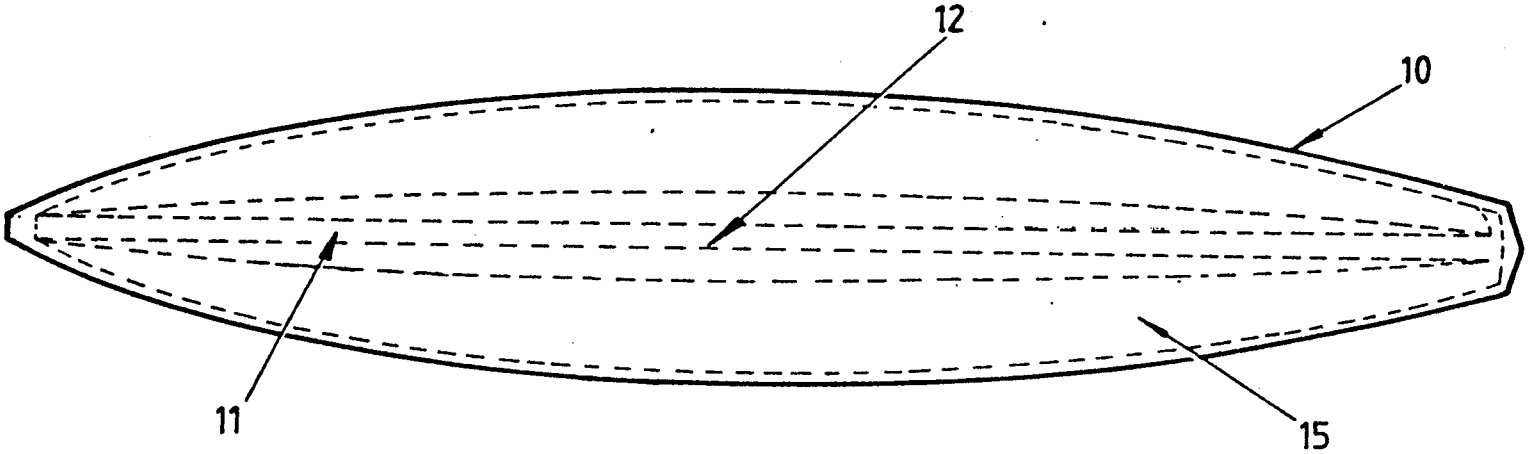
FIG. 1 is a plan view of a surfboard.
Figure 2:
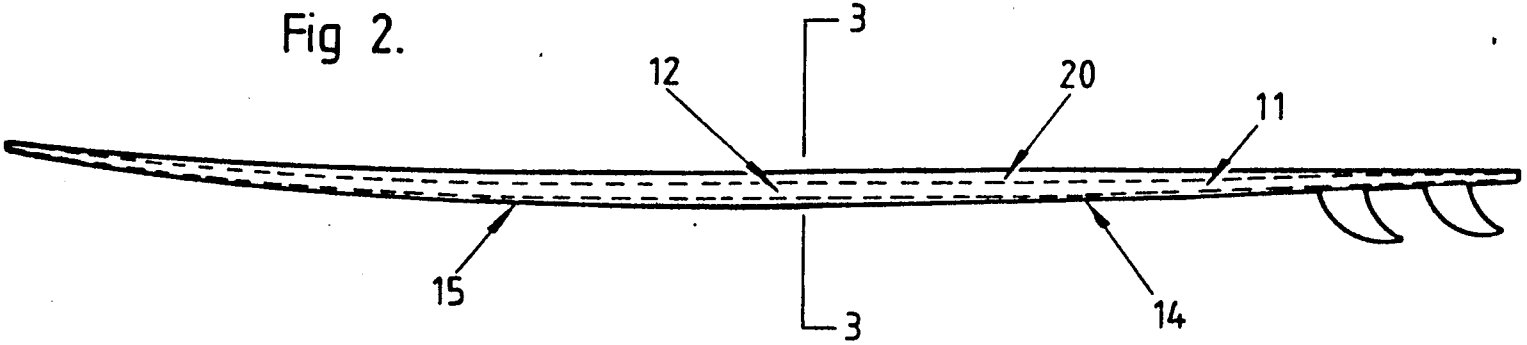
FIG. 2 is a side elevation of the surfboard shown in FIG. 1.

Referring now to the drawings, the surf craft 10 is of a generally conventional contour as seen in FIGS. 1 and 2, having a central longitudinal spine 11, which has a maximum height in the central area 12 in FIGS. 1 and 2, and tapers towards the front and rear ends of the craft.

Figure 3:
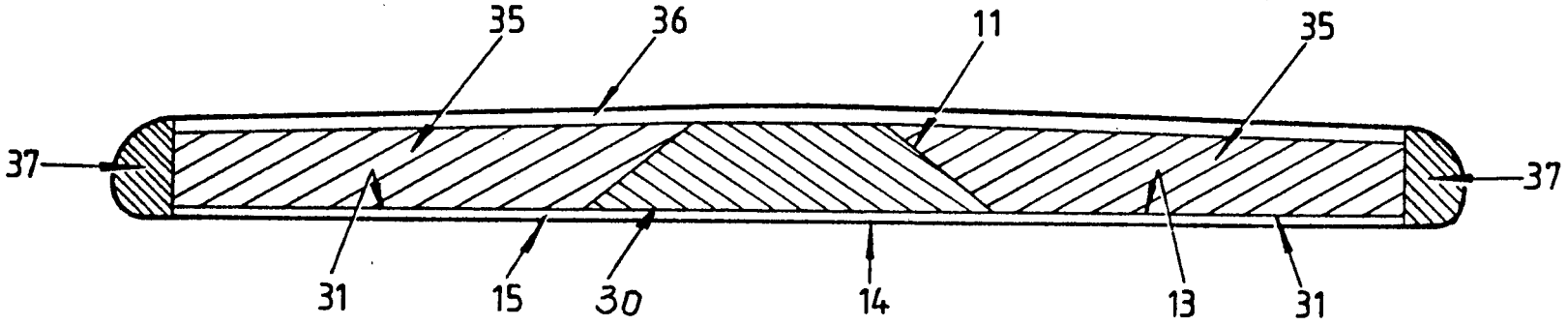
FIG. 3 is a cross-section of the surfboard along the line 3—3 in FIG. 2.
Figure 4:
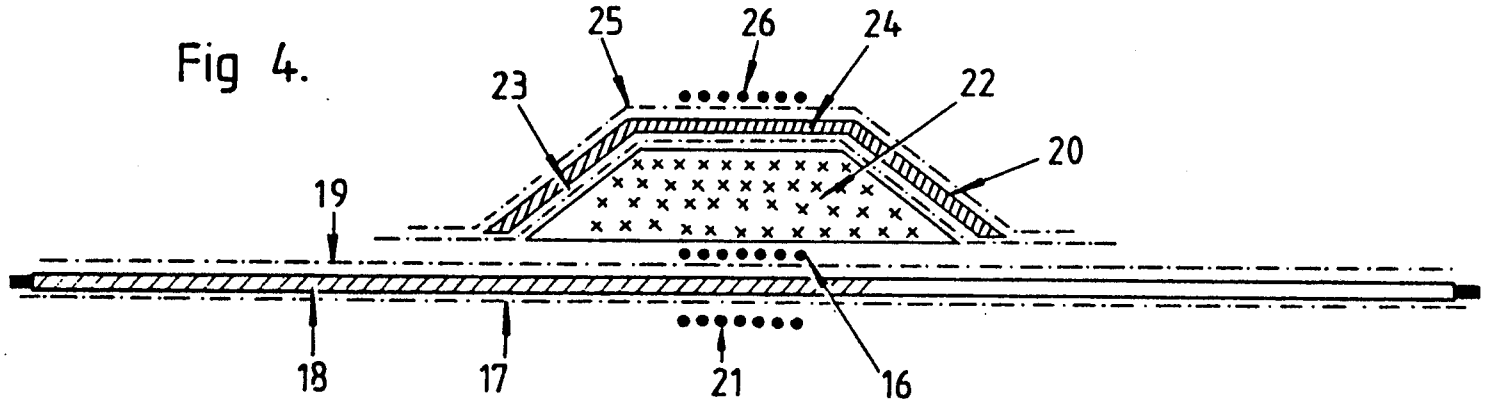
FIG. 4 is a diagrammatic cross sectional view similar to FIG. 3 showing the make-up of the planing plank and spine.

As seen in FIGS. 3 and 4 of the drawings, the craft has a planing portion or plank 15, providing a lower planning surface 14 and has the spine 11 formed integral therewith.

The lower planning plank 15 is of a sandwich construction with a thin core 18 of foam material encased by a shell 13 of fibre reinforced resin. The planing plank may be of a thickness as thin as about 5 mm and up to about 20 mm. The thickness preferably also varies along the length and across the width of the planing plank. The spine 11 may have a foam core or may be hollow. Preferably, the wall of the spine is of a composite construction with a thin foam core and with the interior of the spine hollow.

The planing plank comprises a relatively thin core 18 of PVC, acrylic or other appropriate closed cell foam, laminated on the top and bottom by respective layers of woven or mat fibre reinforced resin 17 and 19. Preferably there extends along the top and bottom of the planing plank 15, centrally thereof additional reinforcement comprised of groups of unidirectional fibres 16 and 21 encased in resin.

The spine 11 is formed by placing centrally on top of the above constructed planing plank 15 a forming core 22 of closed cell foam of a relatively lightweight non-structural nature extending substantially the full longitudinal length of the plank. This forming core 22 is provided primarily as a support during forming and curing of the outer structural shell 20 of the spine. The structural shell 20 comprises inner and outer layers 23 and 25 of fibre reinforced resin sandwiching therebetween a layer 24 of closed cell foam of a structural grade similar to the core 18 of the planing plank 15.

The cross-sectional shape of the shell 20 may be anything from a rectangular shape with opposite parallel sides, to a semi-circular shape. The shell consisting of upward inwardly inclined sides and a horizontal upper face as shown in the drawings, is particularly suitable from the aspect of simplicity to construct and functionality.

In order to provide additional strength in the spine 11 a group of unidirectional fibres 26 is provided centrally of the top face of the outer layer 25 of the spine and running substantially the full length thereof As can be seen in FIG. 4, the inner and outer layers 23 and 25 of fibre reinforcement of the spine 11 project laterally some distance to either side of the spine so that they are laminated with, and form an integral structure with, the upper layer 17 of fibre reinforced resin of the planing plank 11.

The above described construction of the integral planing plank and longitudinal spine assembly constitute the complete structural component of the craft and the additional components incorporated therein as later described are for convenience in use and appearance, but perform no structural function. The planing plank is laid-up in a suitable mould to define the shape of the planing plank in accordance with known fibre reinforced resin moulding techniques and the spine is then laid-up on the planing plank. The completed assembly is then cured preferably in an autoclave and with the assistance of vacuum bags.

The purpose of constructing the integral planing plank and spine is to provide flexibility in the planing plank while maintaining structural strength, the latter being provided by the spine It will be appreciated that the spine 11 and the portion 30 of the planing plank 15 immediately therebelow has a high degree of rigidity in both the transverse and longitudinal directions. However, the respective laterally projecting side portions 31 of the planing plank 11 are relatively thin and hence flexible. This flexibility is achieved while maintaining the required strength to provide durability to the craft over a long period and in severe or strong water conditions.

The strength of the spine 11 can be varied along the longitudinal length of the craft as less strength is required towards the respective ends of the craft compared with the high strength required in the central area. In craft, such as windsurfers, where a mast is used, the mast is mounted in the spine, the spine being specifically strengthened in the area of the mast mounting to accommodate the loads applied by both the mast and the rider.

Although all of the strength and performance characteristics are incorporated in the integral planing plank and spine, it is desirable to provide a continuous upper surface to the craft so that the rider can freely move about thereon to control the craft. The presence of the spine projecting upwardly from the planing plank would interfere with the movements of the rider and could lead to loss of control of the craft and/or dislodgement of the rider from the craft.

In order to overcome this problem a lightweight closed cell foam filler pad 35 is located on each side portion 31 of the planing plank 15 The filler pads 35 abut closely and are bonded to the top face of the planing plank and side face of the spine, respectively, and extends laterally and upwardly to the extremity of the side portion 31 and spine 11, respectively Thus the craft is provided with a continuous smooth upper surface upon which the rider can comfortably and freely move about to control the craft.

The durability of the pads 35 is improved by providing a final cover layer 36 of high density foam over the complete upper surface of the filler pads 35 and spine 11 bonded thereto, such as the flame bonding. The cover layer 36 is typically of a density of 100 kg/cubic meter to provide high wear resistance as compared with the pads 35 that are of low density, as low as 25 kg/cubic meter.

Also as a protection of the perimeter edge of the filler pads 35 and the planing plank 11 a continuous edge rail 37 of high density closed cell foam is provided about the full perimeter edge of the craft. The edge rail 37 may be of the same material as the cover layer 36, however, to reduce weight and as it is subject to somewhat less severe loadings than the cover layer 36 a lower density material may be used, such as 90 to 95 kg/cubic meter. The edge rail 37 is bonded to the perimeter of both the planing plank 11, side filler pads 35, and cover layer 36, such as by flame bonding, contact adhesive or hot melt adhesives. Flame bonding is particularly suitable for bonding foam to foam, however, when bonding to other materials such as fibre reinforced resins, contact or hot melt adhesive are generally preferred.

The claims defining the invention are as follows:

1. A surf craft comprising a planing plank forming the complete lower surface of the craft, a central stiffening spine constructed to have a maximum strength against bending in the direction normal to the planning plank at a location spaced from each end of the craft and such that said strength decreases from said maximum toward each end of the craft, said spine upstanding from and extending substantially the length of the planning plank, said spine being integral with the planing plank to form a structural unit with the planing plank projecting laterally from either side of the central spine, said lateral projections of the planing plank being independently resiliently deflectable in use relative to the central stiffening spine, and filler pads on either side of the spine resting on the planing plank and forming with the spine a platform for a rider of the craft to stand and move about on, said filler pads being resiliently flexible with the planing plank.

2. A surf craft as claimed in claim 1, wherein the planing plank includes an upper and lower surface, each extending across the complete width of the planing plank and formed of a continuous layer of fibre reinforced resin, said spine being integrally secured to said upper surface.

3. A surf craft as claimed in claim 2, wherein at least one of said upper and lower surface forming layers includes a plurality of unidirectional fibres located centrally of the width of the planing plank and extending substantially the longitudinal length thereof.

4. A surf craft as claimed in claim 1, wherein the spine comprises at least one layer of reinforced resin extending longitudinally of the planing plank, said layer having opposite longitudinal edge portions, said longitudinal edge portions being shaped so the opposite longitudinal edge portions abut and are intimately secured to the planing plank with the intermediate portion of the layer between said longitudinal edge portions spaced upwardly from the planing plank to define therewith a longitudinally extending sealed cavity.

5. A surf craft as claimed in claim 4, wherein the spine comprises two layers of reinforced resin with a core of foam material sandwiched therebetween.

6. A surf craft as claimed in claim 4, wherein the planing plank includes an upper and lower surface, each extending across the complete width of the planing plank and formed of a continuous layer of fibre reinforced resin, said spine being integrally secured to said upper surface.

7. A surf craft as claimed in claim 4, wherein at least one of said upper and lower surface forming layers of the planing plank includes a plurality of unidirectional fibres located centrally of the width of the planing plank and extending substantially the longitudinal length thereof.

8. A surf craft as claimed in any one of the preceding claims, wherein the filler pads are of a resilient foam material having a density of less than about 30 kg per cubic meter.

9. A surf craft as claimed in claim 8 including within the filler pads an area of higher density foam material at or adjacent the rear end of the craft where the foot of a rider of the craft may be placed when the craft is in use.

* * * * *